United States Patent [19]

Goettl

[11] 4,255,361

[45] Mar. 10, 1981

[54] AUTOMATIC FLUSHING AND DRAINING RESERVOIR APPARATUS FOR EVAPORATIVE COOLERS

[76] Inventor: Adam D. Goettl, 4960 E. Palomino Rd., Phoenix, Ariz. 85018

[21] Appl. No.: 115,041

[22] Filed: Jan. 24, 1980

Related U.S. Application Data

[63] Continuation-in-part of Ser. No. 007,027, Jan. 29, 1979, Pat. No. 4,192,832.

[51] Int. Cl.[3] ..... B01F 3/04

[52] U.S. Cl. ..... 261/27; 137/101.27; 137/143; 261/70; 261/DIG. 46

[58] Field of Search ..... 261/28, 29, 36 R, 27, 261/70, DIG. 4, DIG. 11, DIG. 46; 137/101.27, 132, 135, 142, 143

[56] References Cited

U.S. PATENT DOCUMENTS

| | | | |
|---|---|---|---|
| 2,031,055 | 2/1936 | McKinney | 261/70 X |
| 2,646,061 | 7/1953 | Bottum | 261/DIG. 46 |
| 2,828,761 | 4/1958 | Weibert, Jr. | 261/36 R X |
| 2,856,166 | 10/1958 | Goettl | 261/29 |
| 3,314,080 | 4/1967 | Shilling, Jr. | 261/DIG. 46 |
| 3,471,123 | 10/1969 | Carlson et al. | 261/70 X |
| 3,476,673 | 11/1969 | Stiles | 261/DIG. 46 |
| 3,643,930 | 2/1972 | Schulze, Sr. | 261/DIG. 46 |
| 3,754,741 | 8/1973 | Whitehurst et al. | 261/DIG. 11 |
| 4,129,140 | 12/1978 | Carlin | 261/DIG. 46 |

*Primary Examiner*—Richard L. Chiesa
*Attorney, Agent, or Firm*—Herbert E. Haynes, Jr.

[57] ABSTRACT

A pump, siphon drain valve, and at least the float portion of a float controlled shutoff valve are located in a comparatively small water reservoir tank which is dependingly formed in the floor pan of an evaporative cooler to locate the cooler's water supply externally of its cabinet and are operative to recirculatingly supply water to the cooler and receive the returning water. The water, which increases in mineral concentration during such recirculation, is periodically drained from the tank by shutting off the pump so that the returning water will elevate the water level in the tank and prime the siphon drain valve. When the pump and water inlet supply are both shutoff, the tank completely drains, and when the pump alone is shutoff, tank draining, flushing and refilling is accomplished.

11 Claims, 7 Drawing Figures

AUTOMATIC FLUSHING AND DRAINING RESERVOIR APPARATUS FOR EVAPORATIVE COOLERS

CROSS-REFERENCE TO RELATED APPLICATION

This application is a continuation-in-part of a copending U.S. patent application Ser. No. 007,027 filed Jan. 29, 1979 by the same inventor, while issued on Mar. 11, 1980 as U.S. Pat. No. 4,192,832.

BACKGROUND OF THE INVENTION

1. Field of the Invention

This invention relates to evaporative coolers and more particularly to an improved automatic flushing and draining reservoir apparatus for use with evaporative coolers.

2. Description of the Prior Art

Evaporative coolers of the type having an air handler mounted in a cabinet for drawing air into the cooler through wettable cooler pads and delivering the evaporatively cooled air to a point of use, have the necessary water supply contained within a floor pan or sump. The water level within the sump is maintained at a predetermined level by a float controlled inlet valve that is suitably connected to a source of water under pressure such as a domestic water line. A pump is mounted in the sump and operates to supply water to the cooler's water distribution system which in turn distributes the water to the cooler pads. The wet cooler pads will cool the air being drawn therethrough by the air handler in accordance with the well known evaporative principle, and the unevaporated water will drain under the influence of gravity from the pads and return to the sump.

During such operation, the water, which inherently contains minerals such as calcium chloride and other impurities, will increase as to its concentrations of those minerals due to the evaporation process. As the mineral concentration increases, the rate of precipitation will also increase which results in mineral deposition, or scaling, of the various cooler components. Such mineral deposition causes calcification of the cooler pads, clogging of the water passages, corrosion of the metal and the like, but the most serious problem is with the electric motors and wiring. When the calcium chloride salts are deposited on the wiring, terminals, and the various parts of the electric motors themselves, moisture in the cooler is attracted to the salts and will form a moist pasty salt substance which shorts out those electric components. To keep such mineral deposition to a minimum, the cooler should be periodically drained, flushed and refilled with fresh water. However, since such draining, flushing and refilling is something which should be accomplished on a regular and a rather frequent schedule, as determined by the characteristics of the water, it is something that is almost always forgotten or simply ignored.

The above described problem of mineral deposition is compounded by the fact the water is stored within the sump which serves as a reservoir. Thus, the various cooler components are continuously subjected to a moist environment by being directly exposed to a relatively large body of water in the bottom of its cabinet. Unless the sump is drained at the end of a cooling season, or prior to other periods of nonuse, such direct exposure of the components to the water body is something that can, and often is, continuous whether the cooler is operating or not. Draining of the sump preparatory to a period of nonuse is no guarantee that the sump will remain dry for the period of nonuse in that leakage from the inlet supply line or rain entering the cooler cabinet through the pads will collect in the sump.

The above described problems and shortcomings of prior art evaporative coolers is something that has long been recognized and various attempts have been made to solve, or at least, minimize some of those problems. For example, devices which dispense chemicals into the water to reduce mineral concentration and deposition problems have been suggested, however, such devices have not received commercial acceptance due to the minimal benefits derived, cost, and the maintenance requirements.

One particular prior art device has been suggested in U.S. Pat. No. 2,828,761, for automatically draining, flushing, and replacing the water in a cooler's sump and for draining a large portion of the water therefrom when the inlet water supply to the sump is shutoff. Briefly, this prior art device includes a sheet metal dam which is located within the sump of the cooler. A one-way check valve is located in the wall of the dam so that water is free to flow from the main reservoir portion of the sump into the relatively smaller dam portion but is prevented from flowing in a reverse direction. A pump and siphon valve are located inside the dam and a float controlled water inlet valve is located in the main reservoir portion of the sump to maintain the water level in the sump and in the dam, due to the free flow through the checking valve, at a predetermined level. During operation of the cooler, the pump delivers water from the dam portion of the cooler's water distribution system which in turn supplies the water to the cooler pads, and the unevaporated water will return from the pads, by gravity, to the main reservoir portion of the sump. When the sump is turned off, water in the cooler's water distribution system will drain back into the dam area only, due to the reverse flow checking provided by the check valve, thus raising the water level therein to a point where it primes the siphon valve. When the siphon valve is thus primed, water in the dam will be drained therefrom and the water in the main reservoir portion of the sump will flow through the check valve into the dam and will exit the dam through the siphon valve. When the water supply is left on during such an operation, the result is that a draining, flushing and water replacement action takes place, and due to the outlet and the siphon valve being sized to drain the sump at a faster rate than the water inlet line can replace the water, the water level will drop until the siphon valve loses its prime, whereupon refilling of the sump with fresh water takes place under control of the float operated water inlet valve. This same operation occurring when the water supply to the cooler is shutoff results in draining of most of the water from the sump.

This particular prior art flushing and draining device has not received commercial acceptance for several reasons. In the first place, the amount of water contained in the water distribution system of an evaporative cooler is quite small and will, in most cases, be insufficient to achieve priming of the siphon valve. Secondly, the check valve of this prior art structure is a constant source of problems in that the water pressure differential on the oppposite sides thereof is all that can be relied upon for opening and closing of the valve, and that pressure differential is exceedingly small. The small pressure differential relied on to open and close the check valve precludes the use of a spring or other device to bias the valve toward its closed position. Therefore, the check valve is a passive rather than a positively acting device, and achieving a fully closed position when such a state is critical is oftentimes not achieved. To illustrate this point, there can be no leakage through the check valve when the draining cycle is initiated in that such leakage would prevent the water level in the dam from reaching the point where the siphon valve is primed. In addition to the passive action of the check valve, it is necessity, is operated under water and this subjects the valve to corrosion, scaling and the like, and the valve often is jammed by foreign matter such as dirt, wood shavings from the excelsior pads and the like. Thirdly, this prior art device is incapable of completely draining all of the water from the dam and the main reservoir portion of the sump in that both the check valve and the inlet to the siphon valve are spaced upwardly from the bottom of the sump. Therefore, the desirability of draining the sump when the cooler is inoperative cannot be completely achieved and a relatively large surface area of water will remain. Further, when the pump is shut off to accomplish a draining, flushing and water replacement cycle, water will not be supplied to the cooler pads for a considerable length of time due to the amount of water that must be drained and replaced to fill the entire relatively large sump before normal operation can be resumed. Since warm air will continue to be drawn through the pads by the air handler during such a cycle, the pads will dry out rather rapidly, and upon drying, dust, dirt and the like will be extracted from the pads by the air moving therethrough.

In addition to the inherent problems of this particular prior art structure, it does nothing to remove the cooler components from direct exposure to the water in the sump either during operation or during nonuse of the evaporative cooler, and is incapable of automatically draining rain water or the like which enters the cooler during nonuse periods.

Therefore, a need exists for a new and improved automatic flushing and draining reservoir apparatus for evaporative coolers which overcomes some of the problems and shortcomings of the prior art.

SUMMARY OF THE INVENTION

In accordance with the present invention a new and improved automatic flushing and draining reservoir apparatus for evaporative coolers is disclosed. The reservoir apparatus includes a tank, which may be integrally formed, or may be suitably attached to the floor pan of the evaporative cooler so as to be located immediately below an opening formed through the floor pan. A pump, siphon valve, and float portion of a float controlled water inlet valve are located in the tank with the pump being used to supply water to the cooler's water distribution system, the siphon valve being used during the flushing and draining operations, and the float controlled water inlet valve being operable to maintain the water level in the reservoir tank at a predetermined operating level.

In operation, the reservoir apparatus of the present invention will deliver water from the tank to the cooler's water distribution system which directs the water to the cooler's pads. Unevaporated water from the cooler pads returns by gravity into the floor pan of the cooler and will pass through the opening thereof into the tank. When the pump is turned off, and the water inlet supply is left on, water returning from the cooler pads will add to the water that drains from the water distribution system to raise the water level in the tank to a flooded level which primes the siphon valve. Such priming of the siphon valve will drain the tank. The flow capacity of the siphon valve is considerably larger than the flow capacity of the inlet water supply line, thus, during draining of the tank fresh water will continuously enter and dilute the water that is being drained. Such diluting will dissolve some of the minerals which were previously precipitated and they will exit the tank during the draining. When the draining is complete, the siphon valve will lose its prime and the float controlled water inlet valve will refill the tank with fresh water. When both the pump and the inlet water supply line are shutoff, the siphon valve will be primed in the above described manner and the tank will be completely drained and will remain that way due to the inlet water supply being shutoff.

Considering that the tank must be large enough to contain the siphon valve, at least the float portion of the water inlet valve, and at least the suction portion of the pump, the tank should be as small as possible with regard to its surface area so that when the evaporative cooler is shutoff the amount of water returning therefrom to the tank will be sufficient to raise the water level from its normal operating level to a level which will prime the siphon valve. The amount of returning water needed to effect priming of the siphon valve is minimal due to the relatively small surface area of the tank, and since both the water returning from the cooler pads and that draining from the cooler's water distribution system are employed to achieve the desired priming of the siphon valve, a sufficient quantity of water is always available to accomplish that task even in the smallest size evaporative coolers.

By placement of the tank below the floor pan of the cooler, water will never stand in the floor pan which reduces scaling and corrosion of the pan itself and the other cooler components, and will also reduce the cooler's direct exposure to a water body having a relatively large surface area. Even further reduction of such direct exposure of the cooler is achieved by providing the tank with a cover that is spaced above the opening formed through the cooler's floor pan. This same positioning of the reservoir tank below the floor pan eliminates the need for a flow checking valve as in the hereinbefore described prior art structure thus eliminating, or substantially reducing, the possibility of scaling, corrosion, or contamination causing the reservoir apparatus to become inoperative.

In the reservoir of the present invention, the inlet to the siphoning valve is located in a downwardly upset dimple, or depression, formed in the bottom of the tank so that the inlet is below the bottom of the tank. This, in conjunction with the lack of a check valve, allows complete and automatic drainage of the water from the cooler and from the reservoir when both the pump and the water supply line are shutoff.

Other advantages, both from manufacturing and aesthetic standpoints, result from the reservoir apparatus of the present invention. Since the water supply is no longer contained within the cooler cabinet itself, the overall height of the cabinet can be reduced which results in a more aesthetically appealing low profile structure, and a substantial savings of material is achieved. Further, the depth of the floor pan can be reduced in that it no longer serves as a reservoir, thus, the floor pan can be the same as the roof pan which results in savings from the standpoints of tooling, material, handling and the like.

Accordingly, it is an object of the present invention to provide a new and improved automatic flushing and draining reservoir apparatus for use with evaporative coolers.

Another object of the present invention is to provide a new and useful reservoir apparatus of the above described character which reduces the scaling, calcification, and corrosion of the cooler by automatically draining, flushing and replacing the cooler's water supply each time the cooler's pump is shutoff.

Another object of the present invention is to provide a new and improved reservoir apparatus of the above described character which will completely drain all of the water from the cooler and the reservoir when the pump and the inlet water supply are shutoff.

Another object of the present invention is to provide a new and improved reservoir apparatus of the above described type which removes the water supply from the sump, or floor pan, of the evaporative cooler and locates it in a more remote location which reduces scaling, calcification, corrosion and direct exposure of the cooler to a water body having a relatively larger surface area.

Another object of the present invention is to provide a new and improved reservoir apparatus of the above described character which will not add any mechanisms having moving parts that could contribute to failure of the apparatus.

Another object of the present invention is to provide a new and improved reservoir apparatus of the above described character which includes a tank that is positioned below an opening in the cooler's floor pan for containing the cooler's water supply, and receiving the unevaporated water returning from the cooler.

Another object of the present invention is to provide a new and improved reservoir apparatus of the above described type in which the water level in the tank is maintained at a predetermined level by a float controlled water inlet valve having at least the float portion thereof located within the tank.

Another object of the present invention is to provide a new and improved reservoir apparatus of the above described character in which water returning from the cooler's pads and water draining from the cooler's water distribution system upon shutting off of the pump, will raise the water level in the tank to prime a siphon valve mounted therein to cause complete drainage of the tank.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
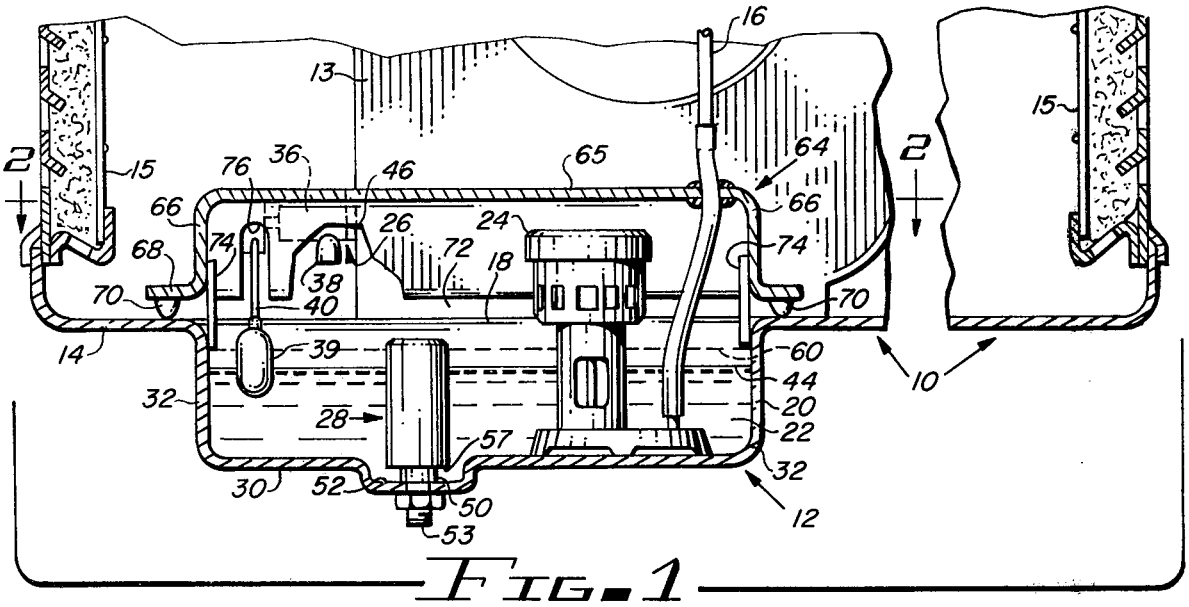
FIG. 1 is a fragmentary sectional view of the typical evaporative cooler which includes the automatic flushing and draining reservoir apparatus of the present invention.

Referring more particularly to the drawings, FIG. 1 shows a fragmentary portion of a typical evaporative cooler, which is indicated generally by the reference numeral 10, with that evaporative cooler including the automatic flushing and draining reservoir apparatus of the present invention, with the apparatus being indicated in its entirety by the reference numeral 12.

The evaporative cooler 10 includes, among other things, an air moving blower assembly 13, a floor pan 14, wettable cooler pads 15, and a water distributing plumbing system or network 16. Since evaporative coolers are well known in the art, it is not deemed necessary to completely illustrate such a structure and only a brief description of operation will be given to facilitate understanding of the reservoir apparatus of the present invention.

Typically, water under pressure is supplied to the plumbing system 16 which carries the water to the upper portion of the cooler's cabinet and distributes it to the top of each of the cooler pads 15. The cooler pads are thus wetted so that air being drawn into the cabinet through the pads by means of the air moving blower assembly 13, will be cooled by evaporation. Some of the water trickling down through the cooler pads 15 will, of course, evaporate and the remaining unevaporated water will drain into the cooler's floor pan 14.

In accordance with the present invention, the floor pan 14 of the evaporative cooler 10 is provided with an opening 18 so that the unevaporated water draining from the cooler pads 15 will pass through the opening 18 into the automatic draining and flushing reservoir apparatus 12 of the present invention.

As will hereinafter be described in detail, the automatic flushing and draining reservoir apparatus 12 of the present invention, includes the major components of a tank 20 for containing water 22 that is used in operation of the cooler 10, a pump 24 for supplying the water 22 to the cooler, a float controlled shutoff valve 26 for initially supplying the water 22 to the tank and periodically supplying makeup water thereto, and a siphon drain valve 28 which is employed for draining purposes.

Figure 2:
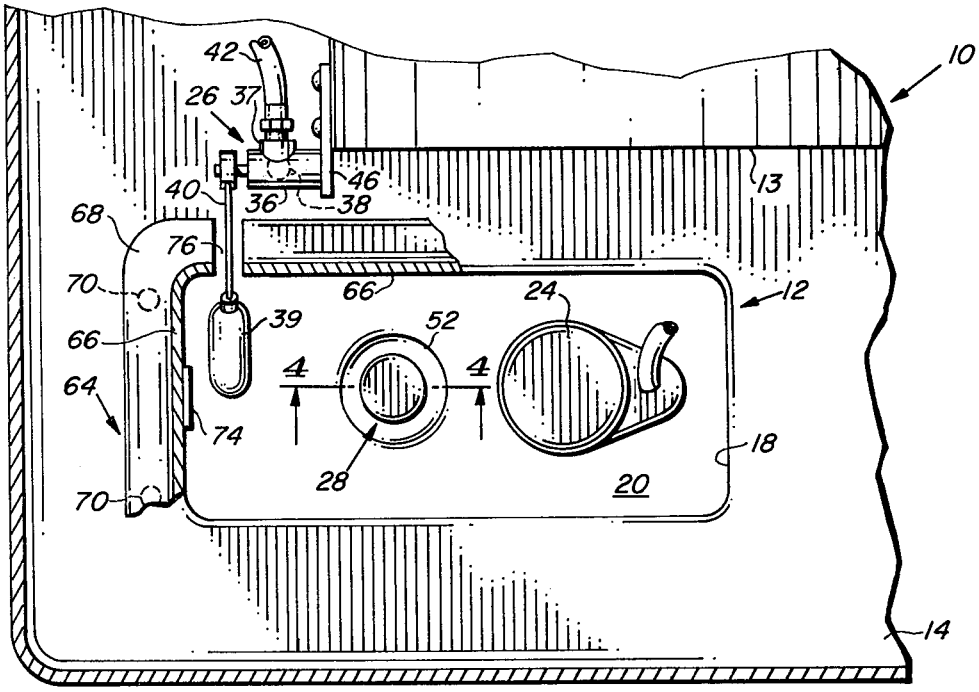
FIG. 2 is a section view taken on the line 2—2 of FIG. 1.

As seen in FIGS. 1 and 2, the tank 20 is an upwardly opening structure having a bottom wall 30 with integral upstanding sidewalls 32. The tank may be of any convenient configuration, such as the rectangular shape shown, and may be formed integral with the floor pan 14 such as by a well known metal drawing operation, or the tank may be mounted to the bottom of the floor pan 14 in any suitable manner so as to be located below the opening 18 formed therethrough. With regard to physical size, the tank 20 is formed so as to present as small a water surface area as is possible for reasons which will hereinafter be described in detail.

The float controlled shutoff valve 26 includes the usual valve assembly 36 having a water inlet boss 37, a water outlet boss 38, and is operated in the well known manner by a float 39 that is carried on the extending end of a rod 40 which is connected to the operating parts (not shown) of the valve assembly. A water supply line 42 has one of its ends connected to the water inlet boss 37 of the valve assembly 36 and its opposite end (not shown) is for connection to a suitable source of water under pressure such as a domestic water line. In this manner, the water 22 will be initially supplied to the tank 20 and thereafter will be periodically reopened under control of the float 39 to supply makeup water thereto and thus maintain the water level in the tank 20 at a predetermined normal operating level 44.

The entire float controlled shutoff valve 26 may be physically located within the tank 20 itself however, in the interest of keeping the tank as small as possible, it is preferred that the valve assembly 36 be located remote from the tank 20 and positioned so that the rod 40 extends therefrom to locate only the float 39 within the tank 20.

The valve assembly 36 may be mounted in any convenient place within the evaporative cooler 10, such as that shown in FIGS. 1 and 2 wherein the valve assembly 36 is supported immediately above the bottom of the cooler's floor pan 14 on a bracket 46 which is suitably mounted on the air moving blower assembly 13, and the rod 40 extends from the valve assembly to position the float 39 within the tank 20. When the valve assembly 36 is located as described above, the initial supply and makeup water delivered through the float controlled shutoff valve 26 will be deposited into the floor pan 14 of the evporative cooler 10 and will drain under the influence of gravity through the opening 18 into the tank 20.

Figure 3:
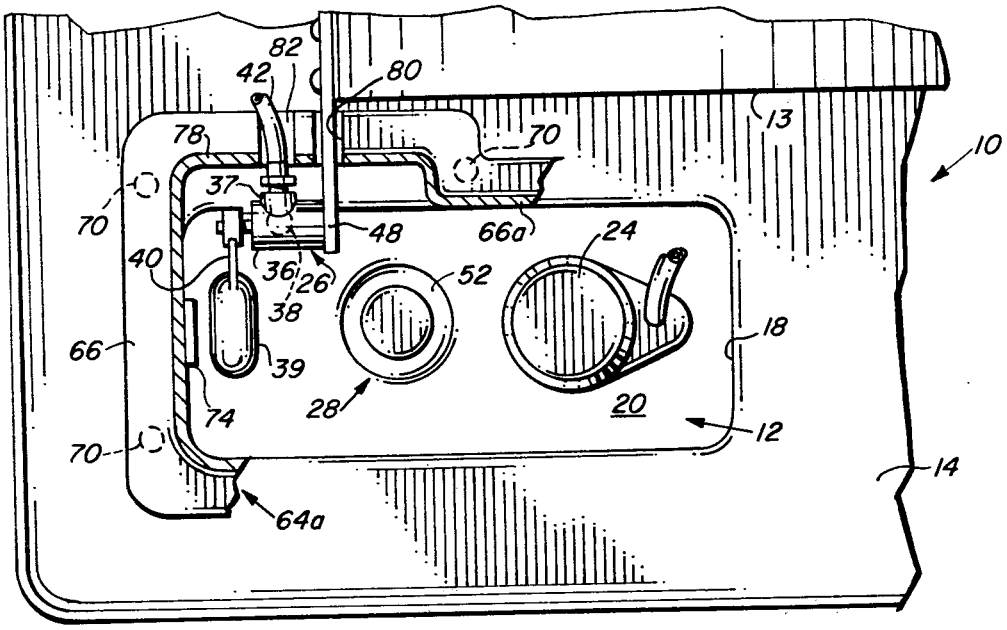
FIG. 3 is a sectional view similar to FIG. 2 and showing a modification of the automatic flushing and draining reservoir apparatus of the present invention.

An alternate technique for mounting the float controlled shut-off valve 26 is shown in FIG. 3 wherein the valve assembly 36 is supported above the opening 18 and thus above the tank 20. An elongated support bracket 48 has one of its ends attached to the air moving blower assembly 13 and the valve assembly 36 is suitably carried on the opposite end of the bracket. With the valve assembly 36 mounted above the tank 20, the float 39 will be carried on the rod 40 depends angularly downwardly therefrom and the water outlet boss 38 of the valve assembly 36 is positioned so that the initial supply and makeup water will be delivered directly into the tank 20.

The pump 24 may be of any suitable type which will pump the water 22 from the tank 20 into the water distribution plumbing network 16 of the evaporative cooler 10.

Figure 4:
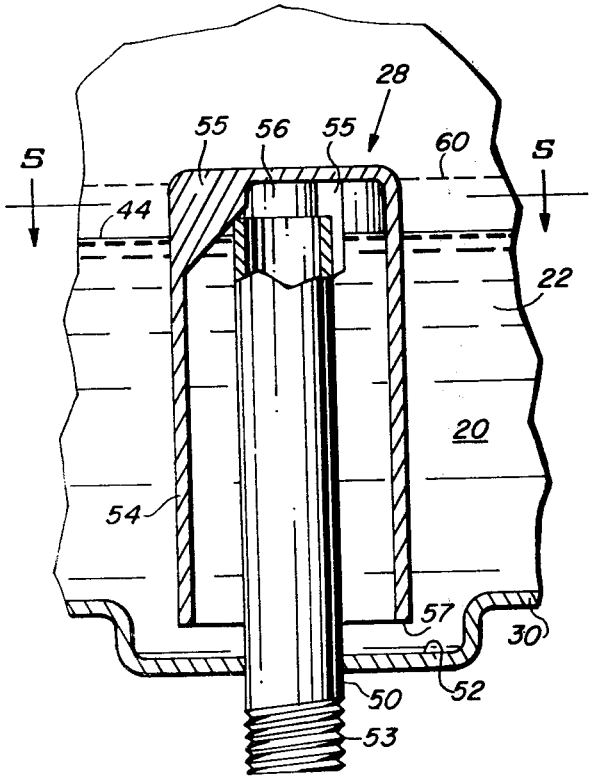
FIG. 4 is an enlarged fragmentary sectional view taken along the line 4—4 of FIG. 2.
Figure 5:
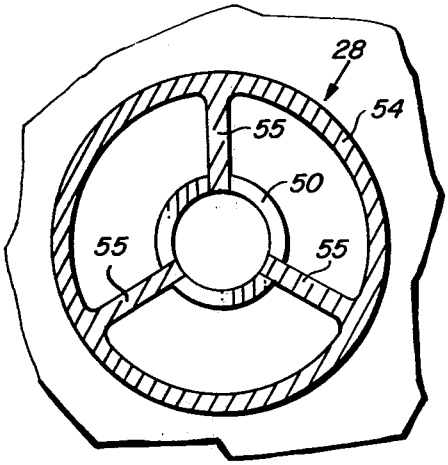
FIG. 5 is an enlarged sectional view taken along the line 5—5 of FIG. 4.

The siphon drain valve 28 as seen best in FIGS. 4 and 5, includes a standpipe 50 that is mounted in a downwardly upset dimple or depression 52 formed in the bottom wall 30 of the tank 20. The bottom end of the standpipe 50 passes through the bottom of the depression 52 and is provided with threads 53 by which a hose (not shown) or other disposl means may be connected thereto. A cylindrical cap 54 is coaxially demountably mounted on the standpipe 50 and is provided with internal webs 55 in the upper closed top portion thereof. The webs are designed to engage the upper end of the standpipe 50 for mounting purposes and to provide an open water passage zone 56 between the top of the standpipe 50 and the closed top end of the cap 54, with the zone 56 being located above the normal operating water level 44 in the tank 20. The cap 54 is provided with an elongated skirt portion which has a bottom edge 57 that is located within the dimple or depression 52. The purpose for locating the bottom edge 57 of the cap in the depression 52, and locating the open zone 56 immediately above the normal operating water level 44 will hereinafter be described in detail.

In normal operation of the evaporative cooler 10, water under pressure is initially supplied to the tank 20 through the float control valve 26 to achieve the normal operating water level 44, and the float controlled valve will periodically open to supply makeup water to replace that lost by evaporation. The pump 24 will deliver the water 22 to the distribution plumbing network 16 of the cooler 10, which wets the cooler pads 15 as hereinbefore described. The unevaporated water draining from the pads 15 will return to the tank 20 through the opening 18 in the floor pan 14 of the cooler, and recirculation of the water will continue as long as no externally applied interrupting force is applied.

The water 22 in the tank 20 will become increasingly contaminated with dirt and the concentration of minerals will increase during the above described normal operation of the cooler 10, and periodic flushing and replacement of the water is desirable to prolong the life of the cooler. Periodic flushing may be accomplished by shutting off the power to the pump 24 which allows the water in the cooler's plumbing network 16 to drain back into the tank 20, which in conjunction with the unevaporated water draining back from the cooler pads 15, will raise the water level in the tank 20 from its normal operating water level 44 to a flooded level 60 which is shown in dotted lines in FIGS. 1 and 4. When the water raises to the flooded level 60, the zone 56 will be under water which results in priming of the siphon valve 28. With the siphon valve 28 primed, the water 22 will be drained from the tank 20. It will be noted that the size of the standpipe 50 is considerably larger in diameter than the water supply line 42, therefore, the rate at which the tank 20 is drained in considerably faster than the incoming rate of fresh water supplied through the float controlled shutoff valve 26. In this manner, a flushing action will take place and when the drainage is complete, the siphon valve 28 will lose its prime and fresh water will fill the tank 20 to the normal operating level 44 and normal operation of the evaporative cooler 10 will be resumed.

The above described flushing and water replacement operation should be accomplished at periodic intervals during operation of the evaporative cooler 10 as hereinbefore mentioned. When operation of the cooler is to be terminated, such as at the end of a cooling season, or at other times of anticipated prolonged nonuse, shutting off of the power to the pump and shutting off of the water supply to the tank 20 will completely drain the tank. Complete drainage is desirable so that the cooler 10 will not contain a standing body of water during periods of nonuse. It will be noted that positioning of the bottom edge 57 of the cap 54 within the depression 52 formed in the bottom of the tank 20 will cause complete drainage of the tank's bottom and only a relatively small amount of water will remain within the depression 52.

The water surface area within the tank 20 should be kept as small as possible. The reason for this may be apparent from the above operational description wherein it will be noted that when the pump 24 is shut-off the water returning from the cooler to the tank 20 will cause the siphon valve 28 to be primed. If the water surface area of the tank 20 is excessively large, the amount of returning water may be insufficient to raise the level of the water to the flooded level 60, and if the water level is raised slowly, due to an excessively large surface area, the water may simply spill over the upper edge of the siphon valve standpipe 50. In either case, the water passage zone 56 would not become completely flooded and this is necessary to cause priming of the siphon valve 28.

In addition to the foregoing, the automatic flowing and draining reservoir apparatus 12 of the present invention, preferably includes a cover 64 which shields the interior of the evaporative cooler 10, and its components from direct exposure to the water 22 within the tank 20, and this reduces the moisture content and mineral deposition within the cooler.

As seen in FIGS. 1 and 2, the cover 64 is a downwardly opening structure which is of substantially rectangular configuration similar to that of the tank 20. The cover 64 has a closed top wall 65 from which sidewalls 66 integrally depend, with the sidewalls 66 being aligned with the sidewalls 32 of the tank 20. The lowermost edges of the sidewalls 66 are bent outwardly so as to be normal with the sidewalls 66 and thus form a substantially endless flange 68. A plurality of spacers 70 are suitably affixed to the downwardly facing surface of the flange 68 and the spacers 70 are in resting engagement with the upwardly facing surface of the floor pan 14. Thus, the cover 64 is in spaced relationship above the opening 18 to provide a gap 72 through which the water returning from the pads 15 is free to enter the tank 20. The cover 64 is demountably positioned as shown, and is provided with a plurality of cover stabilizing tabs 79 which depend from the interior surfaces of the sidewalls 66 into bearing engagement with the aligned interior surfaces of the sidewalls 32 of the tank 20. The cover 64 is provided with a slot 76 formed in one of the sidewalls 66 thereof with the rod 40 of the float controlled shutoff valve 26 passing through the slot to locate the float 39 within the tank as hereinbefore described.

In the modified embodiment of the automatic flushing and draining reservoir apparatus 12 shown in FIG. 3, the cover is shown as having been modified and is identified by the reference numeral **64*a*. The cover 64*a* is essentially the same as the cover 64 with the exception of a lateral bulge 78 formed in one of the sidewalls 66*a* thereof to accommodate placement of the float controlled shut-off valve 26 within the cover. The sidewall 66*a* is provided with a first slot 80 through which the extended support bracket 48 passes and a second slot 82 for the water supply line 42**.

It will be noted that the exact configuration of the cover 64 is unimportant as long as it shields the evaporative cooler from the hereinbefore described effects of a body of water. For example, the cover could be in the form of a flat plate (not shown) having a suitable hole formed therethrough so that the pump 24 would extend through the cover and having a suitable opening or openings to accommodate the float controlled shut-off valve 26.

The above described automatic flushing and draining reservoir apparatus 12 of the present invention is automatic only to the extent that it will automatically flush, or drain in response to the pump 24 being shut-off and such will, in most instances, be accomplished manually. A fully automatic system can be employed such as those shown in FIGS. 6 and 7 and as will now be described in detail.

Figure 6:
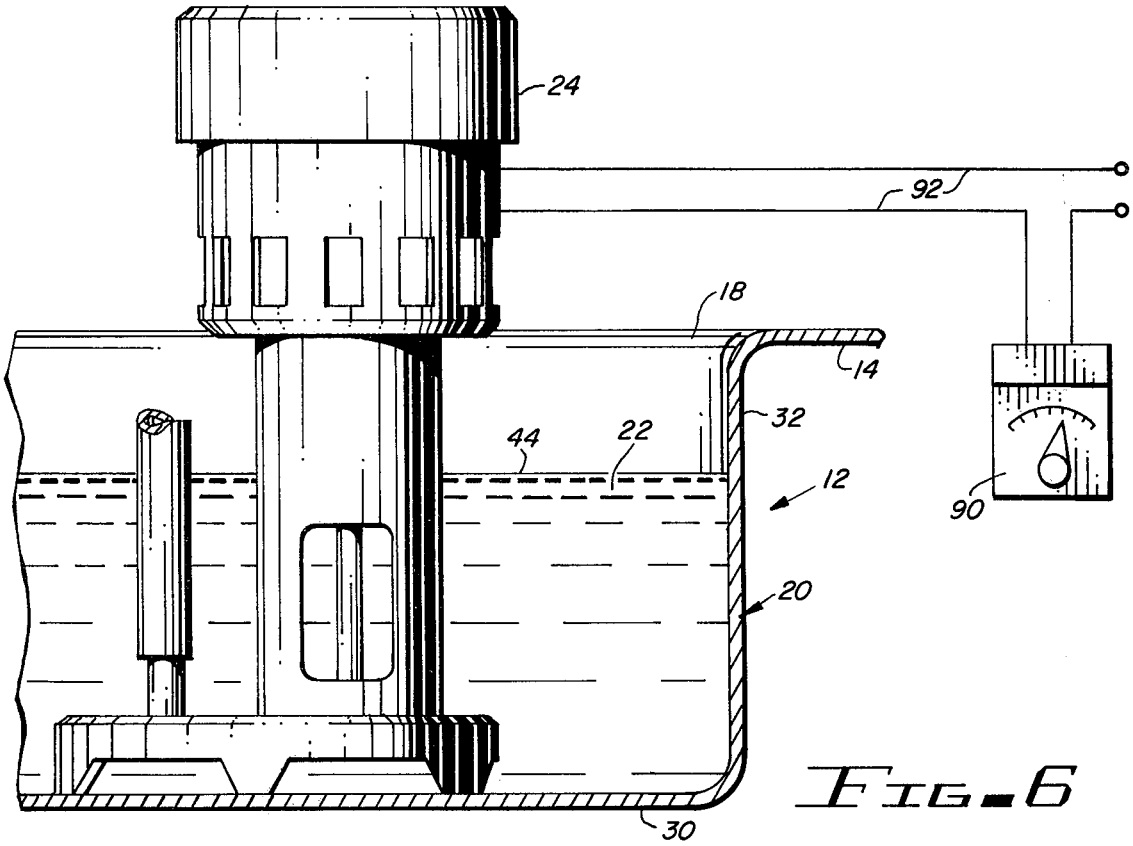
FIG. 6 is a fragmentary sectional view of the reservoir apparatus of the present invention which schematically shows a first means for automatically and periodically switching the apparatus of the present invention into a draining, flushing and water replacing operational mode.

In FIG. 6 a suitable normally closed timing and delay service 90 is mounted in the power supply line 92 leading to the pump 24, and at predetermined intervals, such as 24 hours, the timing and delay device 90 will open the power line 92 leading to the pump 24. Such interruption will start the flushing operation and the delaying function accomplished by the timing and delay mechanism 90 will continue such interruption for a sufficient length of time to allow the completion of the flushing operation.

Figure 7:
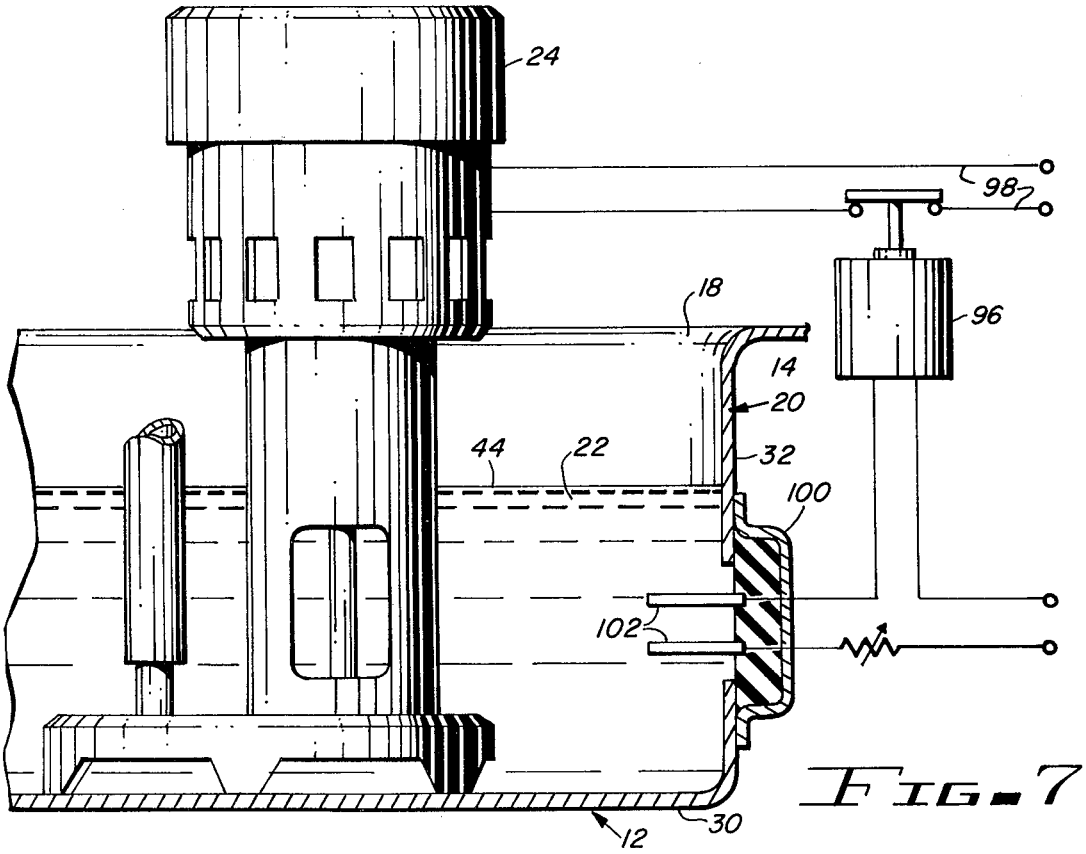
FIG. 7 is a view similar to FIG. 6 and schematically illustrating a second means for automatically and periodically switching the apparatus of the present invention into a draining, flushing and water replacing operational mode.

In FIG. 7, a normally closed 96 is mounted in the power supply line 98 of the solenoid 96 and energization of the solenoid is controlled by a conductivity sensing mechanism 100. When the water 22 in the tank 20 is relatively fresh, i.e., having a relatively low concentration of dissolved minerals, the water will act as an electrical insulator so that no current will flow between the probes 102 of the sensing mechanism 100. When the concentration of minerals increases in the water, which will occur as hereinbefore described, to a point where the water is sufficiently conductive, current will flow between the probes and the solenoid 96 will be energized thus, interrupting power to the pump 24.

While the principles of the invention have now been made clear in illustrated embodiments, there will be immediately obvious to those skilled in the art, many modification of structure, arrangements, proportions, the elements, materials, and components used in the practice of the invention, and otherwise, which are particularly adapted for specific environments and operation requirements without departing from those principles.

For example, the hereinbefore disclosed siphon drain valve 28 is the preferred embodiment due to its compact configuration. However, other structurally different siphoning devices could be used without effecting the operation of the apparatus 12, such as the well known inverted U-shaped siphon tube.

The appended claims are therefore intended to cover and embrace any such modifications within the limits only of the true spirit and scope of the invention.

What I claim is:

1. An automatic flushing and draining reservoir for an evaporative cooler comprising:

(a) an evaporative cooler including a water distribution plumbing system for carrying water to the upper portion of said cooler and a floor pan for receiving unevaporated water draining by gravity from the upper portion of said cooler;

(b) a tank integrally and dependingly formed in the floor pan of said cooler and opening upwardly to receive the unevaporated water from said floor pan, said tank having a cross sectional area which is less than the cross sectional area of the floor pan of said evaporative cooler with the opening of said tank being substantially equal to the cross sectional area of said tank;

(c) a float controlled shutoff valve means for supplying water from an external source of said tank and maintaining it at a predetermined operating level;

(d) pump means for pumping water from said tank into the water distribution plumbing system of said cooler and allowing the pumped water in the distribution plumbing system to drain back into said tank upon interruption of the operation of said pump means so that this returning pumped water in conjunction with the unevaporated water received from the floor pan of said cooler will cause the water level in said tank to rise from the operating level to a flooded level;

(e) a siphon drain valve mounted in said tank with its water inlet adjacent the bottom thereof and having an elevated water passage zone located between the water operating level and the flooded water level of said tank so that its siphoning action will be initiated upon the water level in said tank reaching the flooded level; and (f) said tank being sized with its water surface area as small as possible as determined by its containment of said siphon drain valve, said pump means and said float controlled shut-off valve.

2. An automatic flushing and draining reservoir as claimed in claim 1 wherein said float controlled shut-off valve includes;

(a) a valve assembly mounted in said evaporative cooler at a location remote from said tank;

(b) a valve operating float in said tank for sensing the water level therein; and (c) a rod interconnecting said valve assembly and said float.

3. An automatic flushing and draining reservoir as claimed in claim 1 wherein said valve assembly of said float controlled shut-off valve is mounted in said evaporative cooler at a location above said tank.

4. An automatic flushing and draining reservoir as claimed in claim 1 and further comprising a downwardly upset depression formed in the bottom of said tank within the inlet of said siphon drain valve located within said depression below the bottom of said tank.

5. An automatic flushing and draining reservoir as claimed in claim 1 and further comprising a cover demountably positioned in the floor pan of said cooler in upwardly spaced overlying relationship with said upwardly opening tank.

6. An automatic flushing and draining reservoir as claimed in claim 1 wherein said siphon drain valve comprises:

(a) a standpipe mounted in the bottom of said tank and having an upper end which is located above the operating level of the water in said tank and having a lower end extending through the bottom of said tank; and (b) a cylindrical cap having a closed upper end and an inside diameter which is larger than the outside diameter of said standpipe, said cap mounted in coxial relationship with said standpipe and having webs formed internally at the closed upper end for engaging the upper end of said standpipe so that the water passage zone is located between the upper end of said standpipe and the closed upper end of said cap, said cap having an open bottom which forms the inlet to said siphon drain valve.

7. An automatic flushing and draining reservoir as claimed in claim 1 wherein said pump means comprises:

(a) a pump mounted in said tank; and (b) an outlet line extending from said pump to the water distribution plumbing system of said evaporative cooler.

8. An automatic flushing and draining reservoir as claimed in claim 7 wherein said pump extends upwardly from said tank to position the motor of said pump within the floor pan of said cooler.

9. An automatic flushing and draining reservoir as claimed in claim 1 wherein said pump means comprises:

(a) an electrically operated pump;

(b) an outlet line coupled between said pump and the water distribution plumbing system of said evaporative cooler; and (c) means in the power supply line of said pump for periodically interrupting power to said pump.

10. An automatic flushing and draining reservoir as claimed in claim 9 wherein said means for interrupting power comprises a timing and delay means mounted in the power line of said pump for interrupting current flow at predetermined intervals.

11. An automatic flushing and draining reservoir as claimed in claim 9 wherein said means for interrupting power comprises:

(a) a normally closed solenoid in the power line of said pump; and (b) conductivity sensing means in the power line of said solenoid and in contact with the water in said tank for energizing said solenoid when the conductivity of the water in said tank reaches a predetermined amount.

* * * * *